US007810611B2

(12) United States Patent
Zeng et al.

(10) Patent No.: US 7,810,611 B2
(45) Date of Patent: Oct. 12, 2010

(54) ELEVATOR CAR ASSEMBLY HAVING AN ADJUSTABLE PLATFORM

(75) Inventors: Qingian Zeng, Manchester, CT (US); Patricia A. Derwinski, Farmington, CT (US); Bryan R. Siewert, Westbrook, CT (US)

(73) Assignee: Otis Elevator Company, Farmington, CT (US)

( * ) Notice: Subject to any disclaimer, the term of this patent is extended or adjusted under 35 U.S.C. 154(b) by 491 days.

(21) Appl. No.: 10/577,986

(22) PCT Filed: Nov. 17, 2003

(86) PCT No.: PCT/US03/36753

§ 371 (c)(1),
(2), (4) Date: May 2, 2006

(87) PCT Pub. No.: WO2005/058741

PCT Pub. Date: Jun. 30, 2005

(65) Prior Publication Data

US 2007/0089936 A1 Apr. 26, 2007

(51) Int. Cl.
*B66B 11/02* (2006.01)
*E04G 3/00* (2006.01)

(52) U.S. Cl. ..... 187/401; 248/287.1

(58) Field of Classification Search ..... 187/401, 187/414; 254/129, 130; 248/276.1, 277.1, 248/279.1, 287.1, 274.1; 108/8–9, 149
See application file for complete search history.

(56) References Cited

U.S. PATENT DOCUMENTS 140,074 A * 6/1873 Proctor ..... 108/8
179,961 A * 7/1876 Root ..... 108/4
1,907,967 A * 5/1933 Himes ..... 187/401
2,085,227 A * 6/1937 Norman ..... 248/274.1
2,914,286 A * 11/1959 Weaver ..... 248/265
3,356,329 A * 12/1967 Santo ..... 248/273
4,044,979 A * 8/1977 Lemmo ..... 248/647
4,361,208 A 11/1982 Jackson et al.

(Continued)

FOREIGN PATENT DOCUMENTS

JP 52047246 A * 4/1977

(Continued)

OTHER PUBLICATIONS

International Search Report dated May 17, 2004, International Application No. PCT/US03/36753.

(Continued)

*Primary Examiner*—Michael R Mansen
*Assistant Examiner*—Stefan Kruer
(74) *Attorney, Agent, or Firm*—Carlson, Gaskey & Olds PC

(57) ABSTRACT

An elevator car assembly (14) includes a frame (28) having a horizontal plank beam (36) beneath a platform assembly (34). A plurality of braces (44) support the platform assembly (34) relative to the frame. The braces (44) include at least one slot associated with a fastener (58, 60) to facilitate adjusting a position of the platform assembly (34) relative to the frame. Adjusting the position of the platform assembly (34) allows for leveling the car frame assembly in an economical manner that does not require the introduction of weights or other expensive balancing measures.

10 Claims, 3 Drawing Sheets

U.S. PATENT DOCUMENTS

| | | | | |
|---|---|---|---|---|
| 5,325,937 | A * | 7/1994 | Suchodolski et al. | 187/401 |
| 5,564,529 | A | 10/1996 | Ericson et al. | |
| 2003/0010577 | A1 * | 1/2003 | Smith | 187/401 |

FOREIGN PATENT DOCUMENTS

| | | | |
|---|---|---|---|
| JP | 52055145 | A | 5/1977 |
| JP | 5485662 | | 6/1979 |
| JP | 5043162 | A | 2/1993 |
| JP | 05246658 | A * | 9/1993 |
| JP | 06080358 | A * | 3/1994 |
| JP | 2002087737 | | 3/2002 |

OTHER PUBLICATIONS

International Preliminary Examination Report dated Nov. 14, 2005, relating to International Application No. PCT/US03/36753.

* cited by examiner

ELEVATOR CAR ASSEMBLY HAVING AN ADJUSTABLE PLATFORM

FIELD OF THE INVENTION

The present invention relates to elevators, and more specifically to an arrangement and method for distributing the load of a car frame and platform assembly to simplify leveling and balancing of the car and frame so as to minimize noise and vibration.

DESCRIPTION OF THE RELATED ART

A traditional elevator car includes a car frame and platform assembly that supports the cabin. The platform assembly is supported upon a plank beam and is stabilized by a pair of rods on either side of the platform assembly.

The platform assembly has conventionally included a steel plate over a plurality of steel stringers. The steel plate provides a smooth surface for the floor of the cabin and the steel stringers provide a rigid structure. Of more recent development are honeycomb platforms. Another recent development is the use of wood composite platforms.

During installation of an elevator car, the platform assembly is mounted to the plank beam using brace rods. The brace rods stabilize and stiffen the frame structure. In a conventional elevator, the beam structures are typically manufactured by a machining method, which often creates curved surfaces that may increase the difficulty of squaring and balancing the car frame. Leveling is important to assure that the platform assembly and car is square relative the car frame. Weights are also commonly installed in particular locations to generally balance the platform assembly. This is a time consuming process that requires determining the sensitive locations in which to apply the weights.

Even though the platform assembly and elevator cab are square relative to the car frame and generally balanced during assembly, the entire car assembly may not be properly balanced when installed in the hoistway. If the car assembly is not properly balanced when installed, the ride quality is reduced. An unbalanced car does not travel smoothly along the guide rails, which may generate vibration and acoustic energy during operation. This possibility is further complicated when the guide rails are not accurately installed.

Traditionally, weight blocks will be added between the platform and subframe at the final stage of installation in an attempt to avoid unequal weight distribution and unbalanced movement. Typically, the procedure is to locate the car in the center of the hoistway, loosen the top roller guides, and allow the car to lean in the direction that indicates the imbalance. By putting weight in different locations on the top of the car to visualize the balance effect, the unbalanced force and moment will be roughly estimated to finalize the location to apply the weights.

One drawback to this approach is that the addition of weight may place unequally distributed loads upon the isolation pads between the cabin floor and the frame. The isolation pads improve ride quality by dampening vibrations that may occur as the car assembly moves along guide rails to minimize vibrations felt by passengers in the cab. The loads associated with the added weights tend to lessen the effectiveness of the isolation pads. Additionally, the added weights tend to reduce the float of guide devices, which may decrease ride quality through an increase in vibration and acoustic energy transmission into the cab. Such vibration and acoustic energy may be particularly prevalent as the relative weight of the platform assembly decreases through the use of advanced, lighter-weight materials and construction.

Accordingly, it is desirable to provide an elevator car assembly and mounting method with a straightforwardly balanced system that minimizes vibration and acoustic energy without increasing the system weight.

SUMMARY OF THE INVENTION

In general terms, this invention is an adjustable elevator car assembly that is easily balanced and leveled during installation.

One example car assembly designed according to this invention includes a frame. A platform is adjustably supported on the frame. The platform is selectively adjustable relative to the frame to equally distribute a weight of the assembly for leveling the car assembly within a hoistway, for example.

One example assembly has a plank beam attached to uprights secured near each end of the plank beam. At least one brace is mounted between the platform and the upright on each side of the frame. The brace stabilizes the platform in a selected position relative to the plank beam and the rest of the frame.

In one example, the brace includes at least one slot for adjusting a position of the platform relative to the frame and for adjusting the position of the brace relative to the corresponding portion of the frame.

One method of assembling a portion of an elevator car assembly designed according to this invention includes placing a platform upon a plank beam. Adjusting the position of the platform relative to the plank beam selectively distributes the platform weight over the plank beam to thereby balance the car assembly.

In one example, after the car assembly is supported in a hoistway, a position of the platform is adjusted relative to the plank beam to level the assembly within the hoistway.

The present invention therefore provides an elevator car and mounting method with a straightforwardly balanced system which minimizes vibration and acoustic energy without increasing the system weight.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
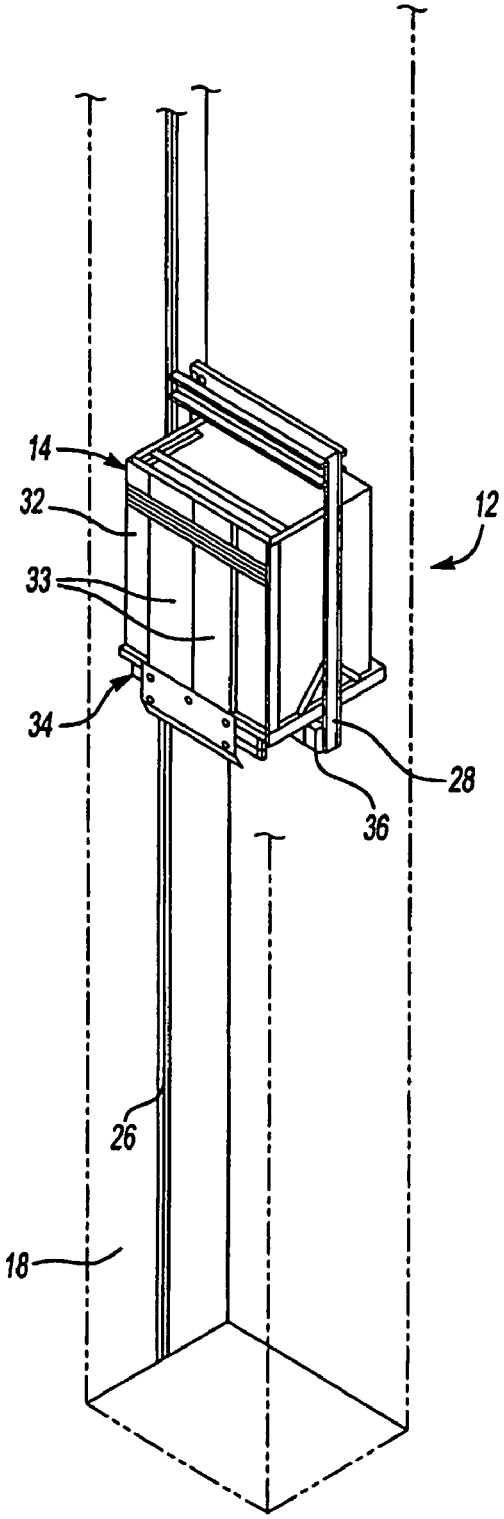
FIG. 1 is a general perspective view of an elevator hoistway and an elevator embodiment for use with the present invention.

FIG. 1 illustrates a general perspective view of selected portions of an elevator system 12. The elevator system 12 includes a car assembly 14 suspended within a hoistway 18. As is known, the car assembly 14 rides on guide rails, such as an example car guide rail 26 shown in FIG. 1.

The car assembly 14 includes a car frame 28, a cab 32 having doors 33, and a platform assembly 34. The car frame 28 and platform assembly 34 support the load of the cab 32 and passengers or freight (not shown) within the cab 32 in a conventional manner. The cab 32 sits on the platform assembly 34, which sits on a plank beam 36.

Figure 2B:
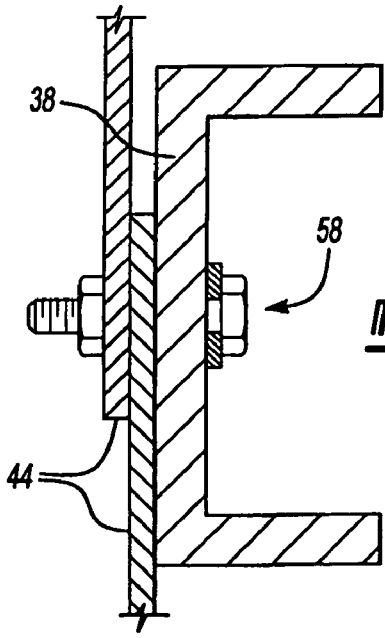
FIG. 2B is a sectional view taken along the line 2B-2B in FIG. 2A.
Figure 2A:
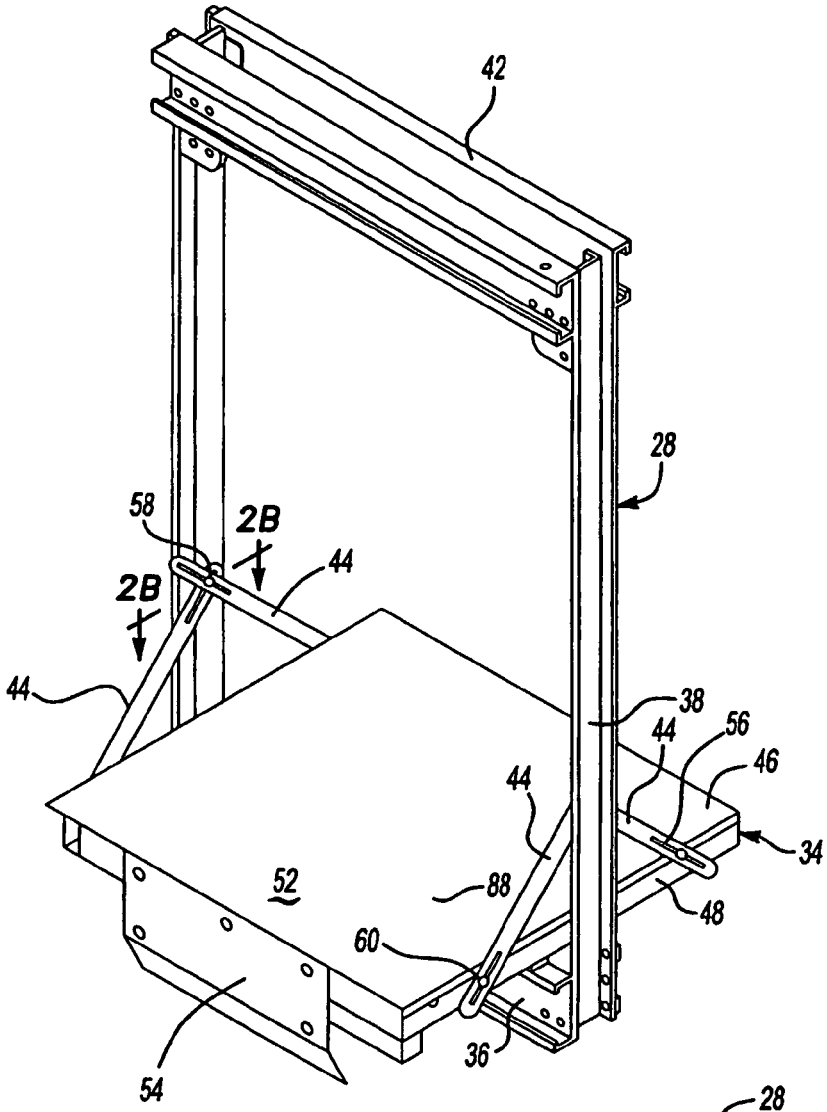
FIG. 2A is a perspective view of a car frame having an adjustably mounted platform designed according to an embodiment of this invention.

Referring to FIG. 2A, the car frame 28 and platform assembly 34 are shown with the cab 32 (FIG. 1) removed. The car frame 28 includes the plank beam 36, uprights 38 extending vertically from the plank beam 36, a crosshead 42 connecting the tops of the uprights 38 and two sets of braces 44. The crosshead 42 is attached to a rope using a conventional hitch (not illustrated), for example.

The platform assembly 34 includes a platform 46, a support frame 48, a door threshold 52, and a toe guard 54. The platform assembly 34 is supported by the plank beam 36 and is stabilized by the braces 44 on either side of the platform assembly 34.

Figure 3A:
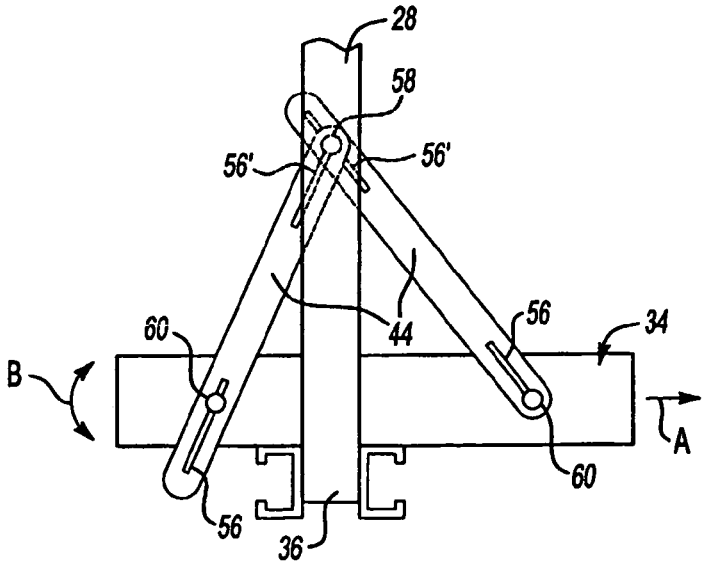
FIG. 3A is a schematic view of an adjustment of the embodiment of FIG. 2A.

Referring to FIG. 3A, each brace 44 has a fixed length and includes at least one slot 56 near an end associated with the platform assembly 34. In the illustrated example, slots 56' are located near the ends adjacent the upright 38. Having at least one slot on at least one brace 44 on each side of the frame 28 facilitates adjusting a position of the platform assembly 34 to balance the car assembly so that it is balanced when installed in a hoistway. In the illustration, each brace 44 is mounted to the corresponding upright 38 through a fastener 58 such as a bolt or the like. Preferably, a single fastener 58 passes through each brace 44 and the upright 38 (also illustrated in FIG. 2B).

The illustrated example takes advantage of having bent sheet steel uprights 38 for using the single fastener 58 to secure one end of the braces 44 against the uprights 38. In a conventional elevator, the beam structures are typically manufactured by a machining method, which creates curved interface surfaces that may increase assembly and adjustment difficulty. By using bent sheet metal, the structures provide a multiple of flat surfaces that lead to more accurate assembly. The flat contact surface between the components 38, 44 provides a planar interface allowing a single fastener 58 to work. Assembly distortion is thereby minimized. In one example, the uprights 38, crosshead 42, plank beam 36 and braces 44 preferably are manufactured of bent sheet steel.

A platform fastener 60 passes through the slot 56 in each brace 44 and a suitable portion of the platform assembly 34 such that the position of each brace 44 can be adjusted.

The position of the platform 34 is readily adjusted relative to the plank beam 36 (as illustrated by arrows A and B) to selectively distribute the weight of the platform assembly 34 over the plank beam 36 (FIG. 3B) to level the car assembly 14 within the hoistway 18. In some example embodiments of the present invention, the platform 34 may not be centered or level relative to the plank beam 36. The braces 44 of the present invention accommodate such geometry. It should be understood that FIG. 3A illustrates an unequal overhang on either side of the beam 36 in exaggerated form for illustrative purposes only. The arrangement of the illustrated example advantageously accommodates relatively significant adjustment.

One way of balancing the car frame using the inventive arrangement includes placing the car frame in a hoistway in a vertically central location. By loosening the roller guides associated with the top of the frame, the frame is free to lean or tilt in one direction responsive to an imbalance. By selectively loosening the fasteners 58 and 60 and manipulating the position of the platform assembly 34 relative to the uprights 38 and the plank beam 36, the car frame can be brought into a balanced position. Once the desired balance is achieved, the fasteners 58 and 60 may be tightened to secure a balanced frame condition.

The brace members 44 having the slots 56 and 56' facilitate moving the platform assembly 34 into the position to achieve the desired balance. Accordingly, the example embodiment of this invention provides a unique way of leveling or balancing a car assembly without requiring additional weights or expensive balancing measures.

Figure 3B:
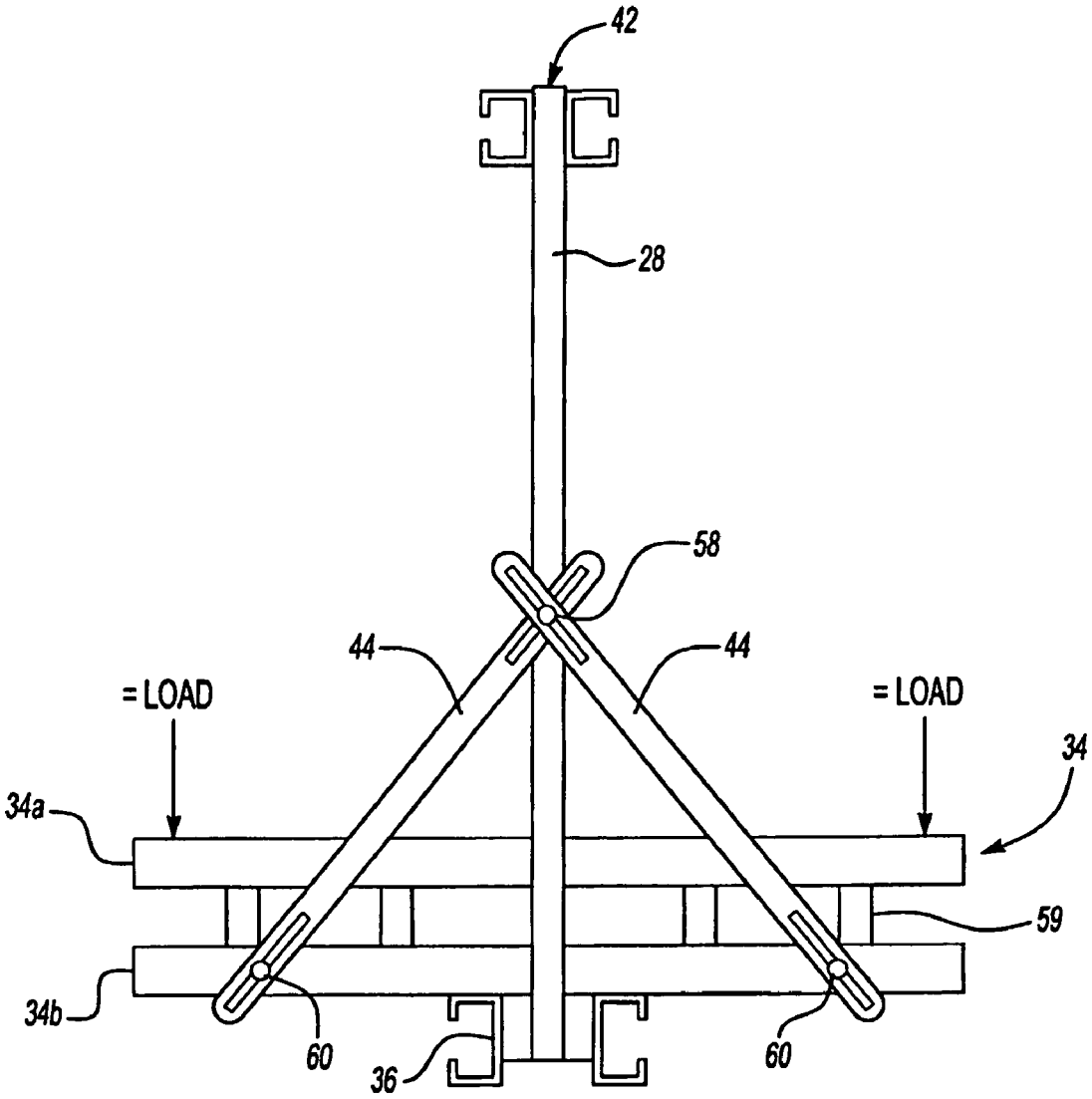
FIG. 3B is a side view of the car frame in FIG. 2A illustrating the platform assembly isolation pads.

As can be appreciated from FIG. 3B, the platform assembly includes isolation pads 59 that operate in a known manner to reduce the amount of vibration and noise transmission through the floor of the cabin 32 of the car assembly. In this example, the isolation pads 59 effectively isolate vibrations of the platform 34*b*, which is directly coupled with other portions of the car frame, from the platform 34*a*, which is directly associated with or provides the floor of the car assembly cabin.

With the example arrangement, the loads on the isolation pads 59 remain equally distributed across the platform assembly 34. This presents a significant advantage compared to previous arrangements where weights were added to a car frame assembly. The addition of such weights often placed unequal loads on the isolation pads and interfered with the ability to adequately reduce noise and vibration transmissions into the cabin. The inventive arrangement, therefore, provides superior ride performance, resulting in a quieter and smoother ride.

The inventive arrangement also allows for more readily leveling a car frame assembly in an economical manner such that tighter assembly clearances of the car frame and other parts become possible. Further, with this invention, elevator systems can have looser tolerances for guiderail installation without degrading the ride quality. The versatility of the car assembly allows for balancing the car relative to guiderails that are installed less accurately than was required to achieve sufficient car balance using prior approaches. It should be understood that other apparatus may be alternatively or additionally utilized to achieve the equal weight distribution of the car assembly 14.

The foregoing description is exemplary rather than limiting in nature. Modifications and variations of the disclosed examples are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

We claim:

1. An elevator car assembly comprising:

a frame including a plurality of uprights and a plank beam between the uprights;

a platform adjustably supported upon said frame, said platform being selectively adjustable relative to said frame to select an amount of the platform that is positioned on each of opposite sides of the uprights for balancing said assembly;

a plurality of braces mounted between said platform and at least one of said uprights, said braces stabilizing said platform in a selected position relative to said plank beam, said plurality of braces mounted in a substantially V-shaped orientation between said platform and said upright, in which two of the braces are legs of a V, a portion of one of the two braces overlapping a portion of the other of the two braces near an end of the braces at the one of said uprights, wherein each of said braces includes a slot; and a single fastener at least partially received through each said slot to secure said overlapping portions of the braces to said upright, wherein each said slot has a longitudinal dimension that is larger than a dimension of said fastener to permit said brace to be longitudinally moveable relative to said fastener into a selected position.

2. The elevator car assembly as recited in claim 1, wherein said brace comprises a steel sheet.

3. The elevator car frame assembly as recited in claim 1, wherein each said brace comprises a second slot and including a second fastener that is at least partially received through said second slot to secure said brace to said platform, said second slot having a dimension that is larger than a dimension of said second fastener to permit said brace to be longitudinally moveable relative to said second fastener into a selected position.

4. The elevator car frame assembly as recited in claim 1, wherein said braces comprise fixed-length braces adjustably mounted to said platform and said uprights.

5. The elevator car frame assembly as recited in claim 1, wherein said platform has a plurality of layers separated by a plurality of isolation pads, said isolation pads having an equal weight distribution thereon.

6. The assembly of claim 1, wherein the two braces each include a second slot near an end of the brace that is secured to said platform by a fastener that is received at least partially through said second slot, each second slot having a longitudinal dimension that is greater than a dimension of the corresponding fastener such that the brace is longitudinally moveable relative to the fastener.

7. An elevator car assembly comprising:

a frame including a plurality of uprights and a plank beam between the uprights;

a platform adjustably supported upon said frame, said platform being selectively adjustable relative to said frame to select an amount of the platform that is positioned on each of opposite sides of the uprights for balancing said assembly;

at least one brace mounted between said platform and at least one of said uprights, said brace stabilizing said platform in a selected position relative to said plank beam, said brace including a slot near an end of said brace that cooperates with said platform such that said end is adjustable relative to said platform to alter a position of said platform relative to said plank beam, said brace including a second slot near an opposite end of said brace that cooperates with said upright such that said opposite end is adjustable relative to said upright to alter a position of said platform;

a second brace mounted between said platform and the one of said uprights, the second brace having a portion that overlaps a portion of the at least one brace where the braces are mounted to one of said uprights, each of the braces including a slot at the overlapping portion; and a fastener received through the slots and securing the braces to the one of the uprights, the slots having a longitudinal dimension that is greater than a dimension of the fastener such that the braces are longitudinally moveable relative to the fastener for selectively positioning the platform relative to the frame.

8. The assembly of claim 7, wherein the platform is adjustable relative to the frame in at least a first direction within a plane of said platform and in a second direction that is not parallel to said plane.

9. The assembly of claim 7, including a plurality of fixed length braces securing said platform in a selected position relative to said frame.

10. The assembly of claim 7, wherein the braces each include a second slot near an end of the brace that is secured to said platform by a fastener that is received at least partially through said second slot, each second slot having a longitudinal dimension that is greater than a dimension of the corresponding fastener such that the brace is longitudinally moveable relative to the fastener.

* * * * *